United States Patent [19]

Garcia

[11] Patent Number: 5,050,760

[45] Date of Patent: Sep. 24, 1991

[54] CLOTHESPIN CADDY

[76] Inventor: Robert L. Garcia, 6847 S. 4th Ave., Tucson, Ariz. 85706

[21] Appl. No.: 592,993

[22] Filed: Oct. 5, 1990

[51] Int. Cl.[5] ..... B65D 25/28

[52] U.S. Cl. ..... 220/94 R

[58] Field of Search ..... 220/94 R; 312/73

[56] References Cited

U.S. PATENT DOCUMENTS

| | | | |
|---|---|---|---|
| 2,520,054 | 8/1950 | Pastorius, III | 312/73 |
| 3,638,822 | 2/1972 | McCoy | 220/94 R |
| 3,692,202 | 9/1972 | Parlagreco | 220/94 R |
| 3,700,160 | 10/1972 | Farrell | 220/94 R |
| 4,058,210 | 11/1977 | Mitchell | 220/94 R |
| 4,632,242 | 12/1986 | Choi et al. | 220/94 R |
| 4,982,863 | 1/1991 | Skillius | 220/94 R |

*Primary Examiner*—Joseph Man-Fu Moy

*Attorney, Agent, or Firm*—Antonio R. Durando; Harry M. Weiss

[57] ABSTRACT

A clothespin caddy that features a waterproof enclosure and drainage for protection of the pins from moisture and ultraviolet radiation, a removable cover for easy access to the pins, a collapsible handle with a specially designed hook for slideably securing the caddy to the clothesline to keep it within reach while hanging clothes, and a compact geometry and structure for efficient storage.

14 Claims, 1 Drawing Sheet

CLOTHESPIN CADDY

BACKGROUND OF THE INVENTION

1. Field of the Invention

This invention is related to the general field of storage containers and dispensers for domestic tools and utensils. In particular, the invention provides a new weather-proof caddy designed for facilitating the use of clothespins and for storing them between uses.

2. Description of the Prior Art

Clothespins have been used for decades for securing laundered articles suspended from clotheslines to dry by natural evaporation. A typical clothespin consists of two pieces of wood or plastic forming a fork clamped shut by the action of a metal spring. Between uses, clothespins are normally left pinned to the clothesline or stored in makeshift containers, so that they are often subjected to damage caused by the weather and other external agents. When left on the line, they are subjected to radiation from the sun as well as moisture, and possibly freeze, from precipitation. After a few seasons of use, plastic clothespins tend to disintegrate from exposure to ultraviolet light and wood ones become brittle from repeated weather cycles.

In order to prevent these problems, people often store clothespins in containers that are not designed for that specific purpose but offer a convenient way to preserve them between uses.

If air-tight, plastic containers are used, of the type normally found in kitchenware for food preservation, the moisture originally in the pins remains trapped in the container, causing corrosion damage to the metal spring and rot to the wooden pieces. If ventilated containers, such as paper bags, cardboard boxes and metal cans, or homemade bags are used, the clothespins may still remain at least partially exposed to the weather because they may be left outside, near the clothesline, for convenience. In addition, all of these containers tend to be awkward to open and close and may rot, oxidize or otherwise deteriorate rapidly.

Another common problem associated with the use of inadequate containers is the difficulty of retrieving each clothespin as needed while hanging clothes on the line. Normally one hand is used to hold the article of clothing on the line while the other hand retrieves the pin, often in a holder on the ground and out of easy reach. Thus, the procedure becomes cumbersome, inefficient, and sometimes impossible.

It would be desirable to have a container especially designed for holding clothespins between uses and for their efficient dispensation during the process of hanging clothes on a line. One such container is described by Pastorious in U.S. Pat. No. 2,520,054 (1950). It consists of an open-ended box of rectangular cross-section with a hook on top for hanging on a clothesline. The top of the box is open but partially obstructed by a pair of horizontal baffles that force clothespins dropped in it to assume a horizontal position before engaging in the downward path toward the bottom of the box. Thus, the pins become stacked in the container in a horizontal position, facing an open slot at the bottom from which they can be grabbed and forced out. A special finger hole in that slot makes it possible for a user to so extract the clothespins one by one.

The use of this device can become complicated when one of the pins lodges itself crosswise along the length of the box, making it very difficult to extract it from the bottom slot. When that happens, all pins become trapped in the container between the baffles at the top and the pin so lodged at the bottom, and they can only be extracted by shaking the container to rearrange them into their correct position. This is likely to occur when pins of different sizes are used, especially if larger than the exact size for which the device's bottom slot is designed. Another problem with the device is that it is open to exposure to rain, if left hanging on the clothesline. Oxidation occurs, resulting in contamination of the pins which, in turn, soil the clothes when used. If it is stored away, on the other hand, the loose pins inside are likely to be shaken out of place and display the above described complication when the container is hung back on the line for use.

Therefore, a need still exists for a problem-free clothespin caddy that is easy to use while hanging clothes on a clothesline and that provides maximum protection to the clothespins while held in storage.

BRIEF SUMMARY OF THE INVENTION

One objective of this invention is the development of a clothespin caddy that insures maximum protection to the clothespins contained in it, whether the caddy is left outside or is stored inside. This is obtained by providing a generally cubical container with a waterproof lid and bottom holes for drainage, which can be kept and used either hanging or resting on a horizontal surface.

Another objective of the invention is a container in which the clothespins cannot become entangled and trapped as a result of random handling. To that end, the caddy described herein has a generally square cross-section sufficiently large to accommodate all common sizes of clothespins and, when open, to allow free access to its interior.

A further goal of the invention is that it be comfortable and efficient to use while hanging clothes on a line. Therefore, this caddy has a handle that can be hung on and slid along the clothesline and a removable cover for easy access to the clothespins.

Yet another goal of the invention is an apparatus that can be efficiently stored between uses. Thus, the caddy according to this invention features a collapsible handle that conforms to the shape of the container to produce a compact unit, and it is free standing, so that it can be easily shelved anywhere.

A final objective is the easy and economical manufacture of the caddy according to the above stated criteria. This is achieved by using commercially available techniques and materials, modified to fit the requirements of the invention.

According to these and other objectives, the present invention describes a clothespin caddy that features a waterproof enclosure and drainage for protection of the pins from moisture and ultraviolet radiation, a removable cover for easy access to the pins, a collapsible handle with a specially designed hook for slideably securing the caddy to the clothesline to keep it within reach while hanging clothes, and a compact geometry and structure for efficient storage.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

This invention consists of the application of simple mechanical principles to achieve a viable solution to the various problems described above in a practical and economical manner. The main point of the invention lies in the idea that the usefulness of a clothespin caddy is directly related to its ease and efficiency of use and to the protection provided to the clothespins during storage.

Figure 1:
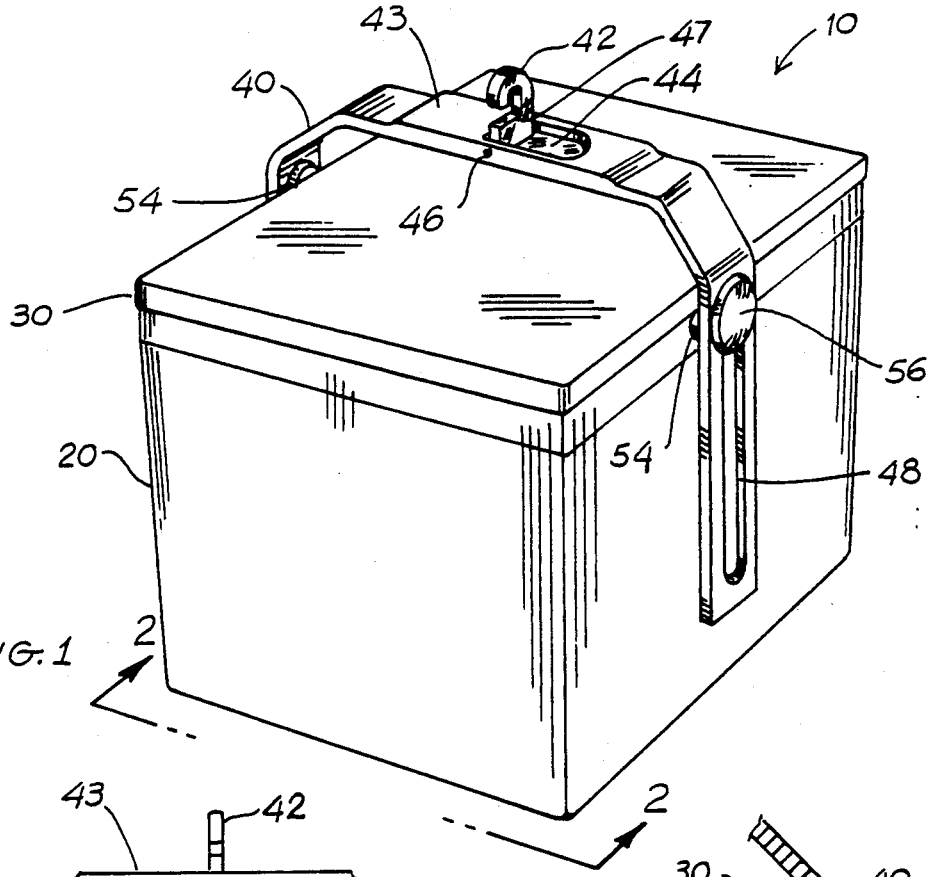
FIG. 1 is a perspective view of a clothespin caddy according to one embodiment of this invention.

Referring now to the drawings, wherein like parts are designated throughout with like numerals, FIG. 1 illustrates in perspective view the clothespin caddy 10 according to the preferred embodiment of this invention. It consists of an approximately cubical container 20 with an open top, normally covered by a lid 30, and attached to a handle 40 incorporating a centrally located hook 42 for handling the caddy and for securing it to the clothesline. The hook 42 is inset into a conforming opening 44 in the top portion 43 of the handle 40 and is hinged on a supporting pin 46 anchored in the handle, so that the hook can be inserted into or extracted out of the opening 44 as desired. The container 20 is sufficiently large to house a multiplicity of average size clothespins and to permit easy access to them through its open top. The bottom of the container features at least one hole (not seen in the figures) to provide drainage and ventilation to the clothespins stored in the caddy.

Figure 2:
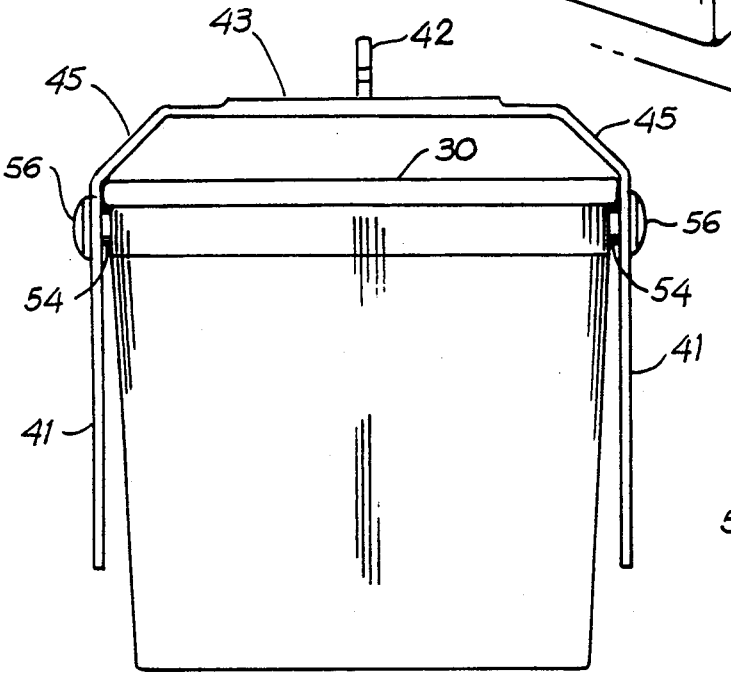
FIG. 2 is an elevational side view of the same caddy when the handle is collapsed into a storage position, as seen from line 2—2 in FIG. 1.
Figure 4:
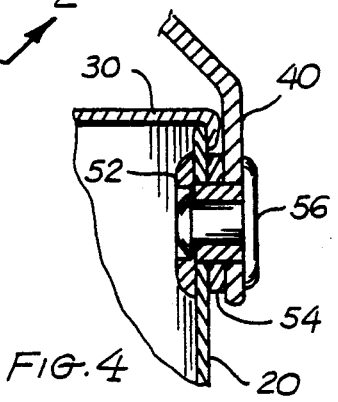
FIG. 4 is a side view of the retainer of FIG. 3 assembled to slideably fasten the handle to the body of the caddy shown in FIGS. 1 and 2.

The lid 30 snaps on the rim of the container 20 to provide hermetic closure for the protection of the pins from moisture and other sources of damage and it may be attached to the body of the container by a strap (not illustrated in this embodiment of the invention) to prevent its loss upon removal from the top of the container. The two vertical portions 41 of the handle 40 project downwardly for a length approximately equal to the height of the container 20 and contain two longitudinal slots 48 through which they are fastened to two opposite sides of the container 20 by special snap retainers 50, illustrated in detail in FIGS. 3 and 4. As shown in FIG. 2, the handle 40 can be collapsed on top of the container to minimize the overall dimensions of the caddy 10 by sliding it down to the point where the retainers 50 reach the top of slots 48. Thus, a compact unit is formed for easy storage in its upright position. When the caddy is used, on the other hand, the handle is extended and the hook 42 extracted from the opening 44 for use in hanging the caddy on the clothesline.

Figure 3:
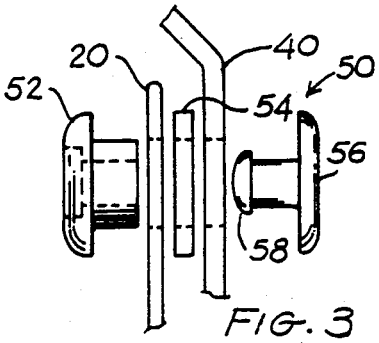
FIG. 3 is a side view of the components of the retainer used to slideably fasten the handle to the body of the caddy shown in FIGS. 1 and 2.

FIG. 3 shows the components of each retainer 50, which is designed for simple and rapid assembly of the unit. It consists of a female member 52 sized to match opposite apertures in two opposite sides of the container 20 and featuring an opening along its main axis for receiving an interlocking male member 56. An enlargement in the interior portion of this opening provides a receiving area for the tip 58 of the member 56 to snap into and hold the assembly tightly together. A washer 54 is added to provide space for the overlapping lip of the lid 30 and to ease the friction from the relative motion of the parts. The retainer 50 is used to fasten each side of the handle 40 to the container 20 by sequentially assembling all parts into the unit illustrated in FIG. 4.

The shape of the handle 40 is designed to flex and withstand the weight of a fully loaded caddy without rupture. As shown in FIG. 2, the vertical portions 41 of the handle are connected to the horizontal portion 43 through short intermediate portions 45 with an angle of approximately 45 degrees between them, rather than through direct 90 degree angle connections. This geometry has been found to increase substantially the strength of the handle by providing a greater and more uniform area available for weight distribution and flexing under strain. Because of its shape and the method of fastening to the body of the caddy, the handle is also capable of sliding and pivoting smoothly around the retainers 50.

The shape and method of attachment of the hook 42 is also designed to optimize its function on a clothesline. The upper portion of the inside surface of the hook is generally round in shape, but the bottom portion is composed of two straight surfaces connected by a 90 degree angle at point 47. This configuration insures maximum stability if the caddy is bounced by wind or other forces while hanging on the clothesline because the resulting motion is less likely to work it free from the line than if it featured a rounded bottom, as in the case of most hooks. The hook 42 is also hinged so that it can pivot around an axis (the pin 46) perpendicular to the vertical plane containing the clothesline, so that its rotation can facilitate the sliding of the hook, and thus the motion of the caddy, along the line.

While the embodiment of the invention shown in the figures features generally rectangular shapes with square corners, it can obviously take other shapes with equivalent functionality and utility. In fact, any shape of the caddy that retains the functional characteristics described herein provides an acceptable apparatus to practice the invention.

It has been found that poly-vinyl-chloride (PVC) is particularly suitable for the manufacture of the clothespin caddy according to this invention because of its smoothness, durability under extreme weather conditions, and resistance to ultraviolet radiation exposure. It can be injection molded according to processes that are well known in the plastic industry. Nevertheless, any durable material would be equivalently adequate.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

What I claim as my invention is:

1. A caddy for efficiently dispensing clothespins while hanging clothes on a clothesline and for storing them between uses, comprising:

(a) a container, sufficiently large to house a multiplicity of average size clothespins and having a removable lid to permit easy access to them, the bottom of said container featuring an aperture to provide drainage and ventilation to the interior of said container;

(b) a collapsible handle slideably fastened to two opposite sides of said container and incorporating a hook for handling said caddy and for securing it to the clothesline; and (c) means for slideably fastening said collapsible handle to said container.

2. The caddy described in claim 1, wherein said collapsible handle comprises two vertical portions that project downwardly for a length approximately equal to the height of said container and contain two longitudinal slots through which said vertical portions are fastened to said two opposite sides of the container by said means for slideably fastening said collapsible handle, so that it can be collapsed on top of said container by sliding it down to the point where said fastening means reach the top of said slots, thus minimizing the overall dimensions of said caddy for compact storage in its upright position.

3. The caddy described in claim 2, wherein said means for slideably fastening said collapsible handle to said container consists of a pair of retainers, each comprising a female member sized to match apposite apertures in said two opposite sides of said container and featuring an opening along its main axis for receiving an interlocking male member, said female member having an enlargement in the interior portion of said opening providing a receiving area for the tip of said male member to snap into and hold the assembly tightly together, and further comprising a washer between said female and male members to create an opening between said container and collapsible handle and to ease the friction from the relative motion of the parts.

4. The caddy described in claim 3, wherein said collapsible handle further comprises a horizontal portion connected to said two vertical portions of the handle through two intermediate portions with connecting angles of approximately 45 degrees, said collapsible handle being so designed to provide a greater and more uniform area for weight distribution and flexing under strain.

5. The caddy described in claim 4, wherein said hook is inset into a conforming opening in said top portion of said collapsible handle and is hinged on a supporting pin anchored in the handle, so that said hook can be inserted into or extracted out of said opening as desired.

6. The caddy described in claim 1, wherein the upper portion of the inside surface of said hook is generally round in shape, and the bottom portion of the inside surface of said hook is composed of two straight surfaces connected by a 90 degree angle in order to insure the stability of said caddy while hanging on a clothesline.

7. The caddy described in claim 6, wherein said supporting pin of said hook is perpendicular to the vertical plane containing said clothesline, so that the rotation of said hook facilitates its sliding, and thus the motion of the caddy, along said clothesline.

8. A method for efficiently dispensing clothespins while hanging clothes on a clothesline and for storing them between uses, comprising the following steps:

(a) providing a container, sufficiently large to house a multiplicity of average size clothespins and having a removable lid to permit easy access to them, the bottom of said container featuring an aperture to provide drainage and ventilation to the interior of said container;

(b) fastening a slideably collapsible handle to two opposite sides of said container by the use of fastening means, said handle incorporating a hook for handling said caddy and for securing it to said clothesline; and (c) hanging said caddy to said clothesline for dispensing clothespins while hanging articles of clothing to dry and storing said clothespins in said caddy while not in use.

9. The method described in claim 8, wherein said collapsible handle comprises two vertical portions that project downwardly for a length approximately equal to the height of said container and contain two longitudinal slots through which said vertical portions are fastened to said two opposite sides of the container by said fastening means, so that said handle can be collapsed on top of said container by sliding it down to the point where said fastening means reach the top of said slots, thus minimizing the overall dimensions of said caddy for compact storage in its upright position.

10. The method described in claim 9, wherein said means for fastening said slideably collapsible handle to said container consists of a pair of retainers, each comprising a female member sized to match apposite apertures in said two opposite sides of said container and featuring an opening along its main axis for receiving an interlocking male member, said female member having an enlargement in the interior portion of said opening providing a receiving area for the tip of said male member to snap into and hold the assembly tightly together, and further comprising a washer between said female and male members to create an opening between said container and collapsible handle and to ease the friction from the relative motion of the parts.

11. The method described in claim 10, wherein said collapsible handle further comprises a horizontal portion connected to said two vertical portions of the handle through two intermediate portions with connecting angles of approximately 45 degrees, said collapsible handle being so designed to provide a greater and more uniform area for weight distribution and flexing under strain.

12. The method described in claim 11, wherein said hook is inset into a conforming opening in said top portion of said collapsible handle and is hinged on a supporting pin anchored in the handle, so that said hook can be inserted into or extracted out of said opening as desired.

13. The method described in claim 12, wherein the upper portion of the inside surface of said hook is generally round in shape, and the bottom portion of the inside surface of said hook is composed of two straight surfaces connected by a 90 degree angle in order to insure the stability of said caddy while hanging on said clothesline.

14. The method described in claim 13, wherein said supporting pin of said hook is perpendicular to the vertical plane containing said clothesline, so that the rotation of said hook facilitates its sliding, and thus the motion of the caddy, along said clothesline.

* * * * *